United States Patent [19]

Downey et al.

[11] Patent Number: 4,655,012

[45] Date of Patent: Apr. 7, 1987

[54] SYSTEM FOR JOINING TWO ADJACENT BUILDING STRUCTURES

[75] Inventors: Donald R. Downey, Tulsa; Donald W. Witten, Collinsville, both of Okla.

[73] Assignee: Nordam, Tulsa, Okla.

[21] Appl. No.: 545,874

[22] Filed: Oct. 27, 1983

[51] Int. Cl.[4] ..... E04H 9/00

[52] U.S. Cl. ..... 52/79.8; 174/35 MS

[58] Field of Search ..... 52/34–36, 52/79.1–79.4, 79.6, 79.7, 79.9, 79.11, 459, 460; 403/43, 167, 192, 201; 174/35 R, 35 MS

[56] References Cited

U.S. PATENT DOCUMENTS

| | | | |
|---|---|---|---|
| 2,682,274 | 6/1954 | Miller | 52/2 D |
| 2,716,782 | 9/1955 | Paulsen | 52/79.8 |
| 2,841,832 | 7/1958 | Couse et al. | 52/79.8 |
| 3,690,077 | 9/1972 | Dalgliesh, Jr. et al. | 52/309.1 |
| 3,717,965 | 2/1973 | Morton et al. | 52/79.1 |
| 3,955,328 | 5/1976 | Lindsay | 52/79.8 |
| 3,962,550 | 6/1976 | Kaiserwerth | 174/35 MS |
| 4,115,656 | 9/1978 | Aitel | 52/79.8 |
| 4,250,669 | 2/1981 | Freeauf | 52/79.8 |
| 4,255,912 | 3/1982 | Kovacs | 52/79.8 |
| 4,407,600 | 10/1983 | Thompson | 403/43 |
| 4,438,612 | 3/1984 | Bernard et al. | 403/43 |

FOREIGN PATENT DOCUMENTS

| | | | |
|---|---|---|---|
| 683010 | 11/1952 | United Kingdom | 403/43 |

*Primary Examiner*—John E. Murtagh
*Assistant Examiner*—Andrew Joseph Rudy
*Attorney, Agent, or Firm*—Head, Johnson & Stevenson

[57] ABSTRACT

A system for joining two adjacent building structures having opposed openings therein to provide weather and electrical shielding of the juncture and wherein the buildings are not required to be in perfect parallel alignment, including a boot formed into a continuous loop of flexible weather and radio frequency impervious material, the width of the boot being at least equal the maximum spacing between the two buildings at the opposed openings, and attachment members for sealably securing the opposed peripherial edge of the boot to the two adjacent buildings, the boot forming a short length tube communicating one building opening with the other.

4 Claims, 12 Drawing Figures

SYSTEM FOR JOINING TWO ADJACENT BUILDING STRUCTURES

SUMMARY OF THE INVENTION

Because of the increase in the costs of buildings constructed in the traditional manner, a large industry has developed in the United States and other countries of the world to manufacture pre-assembled buildings. An important application of manufactured buildings is that of providing closed weather resistant space in remote areas of the world where traditional building materials and trades are not readily available.

While manufactured buildings can very successfully be constructed to be both weather and radio frequency secure, a problem developes when it is necessary to join two manufactured buildings together. In the process of setting up two or more manufactured buildings to be joined into a unitary structure, it is difficult and time consuming to be required to accurately and precisely align such buildings so that they can be joined using typical construction techniques. Buildings joined using standard building techniques requires build-craftsmen which are not normally available in remote geographical areas.

Another problem is that in some locations building structures must be placed on unstable soil where shifting can easily occur, such as on permafrost areas. If two buildings are joined together and shifting occurs, the juncture can become damaged so as to be a source of leakage into the interior of the buildings of stray radio frequency signals.

The present invention is directed towards a unique and novel system of joining two adjacent buildings, each having an opening therein of approximately the same size. The buildings to be joined are placed in juxtapose relationship with the openings aligned with each other. The alignment need not be perfect nor do the buildings need to be spaced at a precise distance from each other. The method of this invention permits adjacent buildings to be very quickly and expeditiously joined to each other in a weather proof and radio frequency interference proof arrangement wherein the buildings can be slightly askew with respect to each other or where the openings are not identical in size and configuration (as long as they are of approximately the same size and configuration). Further the invention provides a means wherein buildings can be joined so that shifting of the buildings with respect to each other after they are joined using will not destroy the weather proof and radio frequency proof integrity of the juncture.

The invention is achieved by providing a boot formed into a continuous loop of flexible weather impervious material. The length of the boot is at least equal to the maximum spacing between the two buildings to be joined, at the openings in the buildings. The boot may be a single weather proof unit including a radio frequency resisting metallic screen as part thereof, or two separate boots may be employed with the weather proof boot on the outside and the radio frequency boot on the inside.

Means of sealably securing one peripheral edge of the boot to one building at the opening therein and, in like manner, means is provided for sealably securing the other peripheral edge of the boot to the opening of the adjacent building. This means is preferably in the form of an extrusion having an elongated channel therein with the width of the channel at the bottom being greater than at the top, such as by the means of inclusion of projecting lip portions. The boot has integral interlocking elongated flange portions wnich are received in the groove so that the boot peripheral edges may be expeditiously forced inwardly into the grooves to provide a weather proof locking of the boot to the adjacent buildings.

To secure radio frequency integrity of the openings, a boot of radio frequency resisting screen wire is positioned in a tubular arrangement with the tubular ends in engagement with the building openings. For this purpose, the buildings must have metallic, radio frequency resisting skins. Means is provided for electrically securing the ends of the radio frequency boot to the metallic skins of the adjacent buildings.

The invention will be described and better understood by reference to the attached drawings which illustrate a preferred embodiment of the invention.

DESCRIPTION OF THE PREFERRED EMBODIMENT

Figure 1:
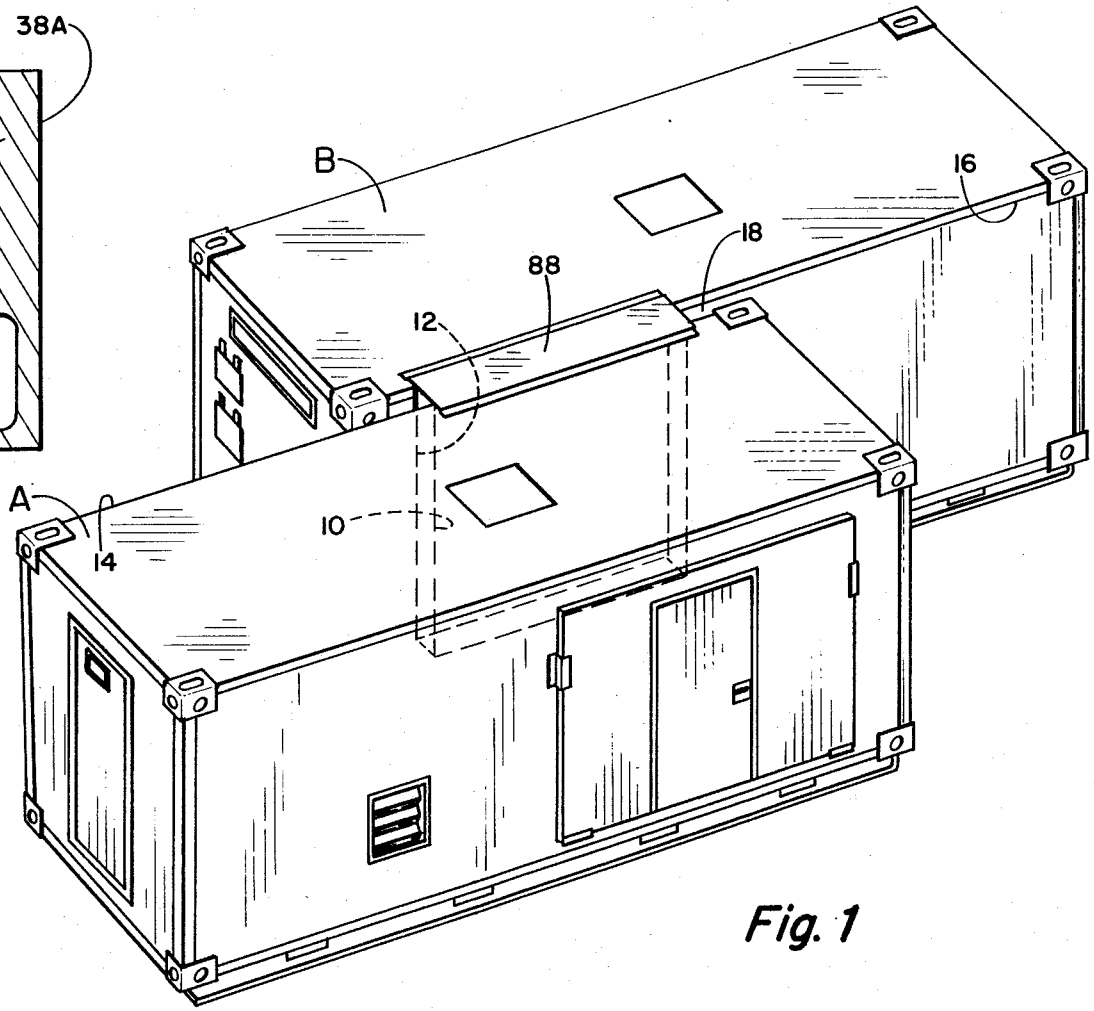
FIG. 1 is an isometric external view of two manufactured buildings positioned adjacent to each other. The invention is a system for joining the two buildings into a weather proof and radio frequency proof unit.

Referring to FIG. 1 two buildings are shown in juxtaposed relationship, the buildings being of the manufactured type such as may be employed for housing radar installations in remote areas of the world, or for any other purpose. Building A has an opening 10 which is opposed to an opening 12 in building B. This invention is concerned with the method of connecting building A and building B so that they can be used as a unitary structure and in a manner wherein the joined buildings are weather proof and radio frequency proof. It can be seen that the buildings A and B could be joined using common building practices but such would require the use of carpentry and electrical trades and a variety of different materials which may not be readily available in remote areas. In addition, the expense and time consumed in connecting buildings A and B with typical construction techniques frequently makes the use of such techniques unadviseable. Therefore the present invention will describe a unique and ingenious system of joining buildings A and B without the necessity of the usual crafts and utilizing a minimum number of components which can be made readily available.

In addition, the present invention will provide a means of joining buildings A and B when the buildings are not necessarily accurately aligned with each other. That is, the sidewall 14 of building A does not necessarily have to be exactly parallel with the sidewall 16 of building B. Further, the openings 10 and 12 may be slightly askew from each and may be of slightly different configurations or sizes. As long as the buildings are in approximate juxtaposed relationship with the openings 10 and 12 of approximately the same configuration and dimensions and if the spacing 18 between the buildings is within the prescribed limits, the buildings can be expeditiously and quickly joined employing the system which will now be described.

Figure 6:
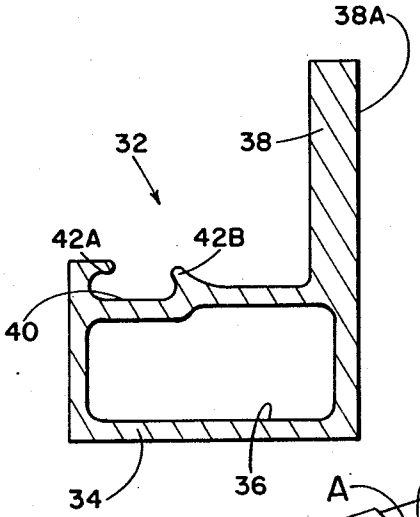
FIG. 6 is a cross-sectional view of an extrusion particularly useful in practicing the invention, the extrusion which may be made such as of aluminum, includes a groove for readily receiving integral wedge shaped portions of the weather proof boot.
Figure 2:
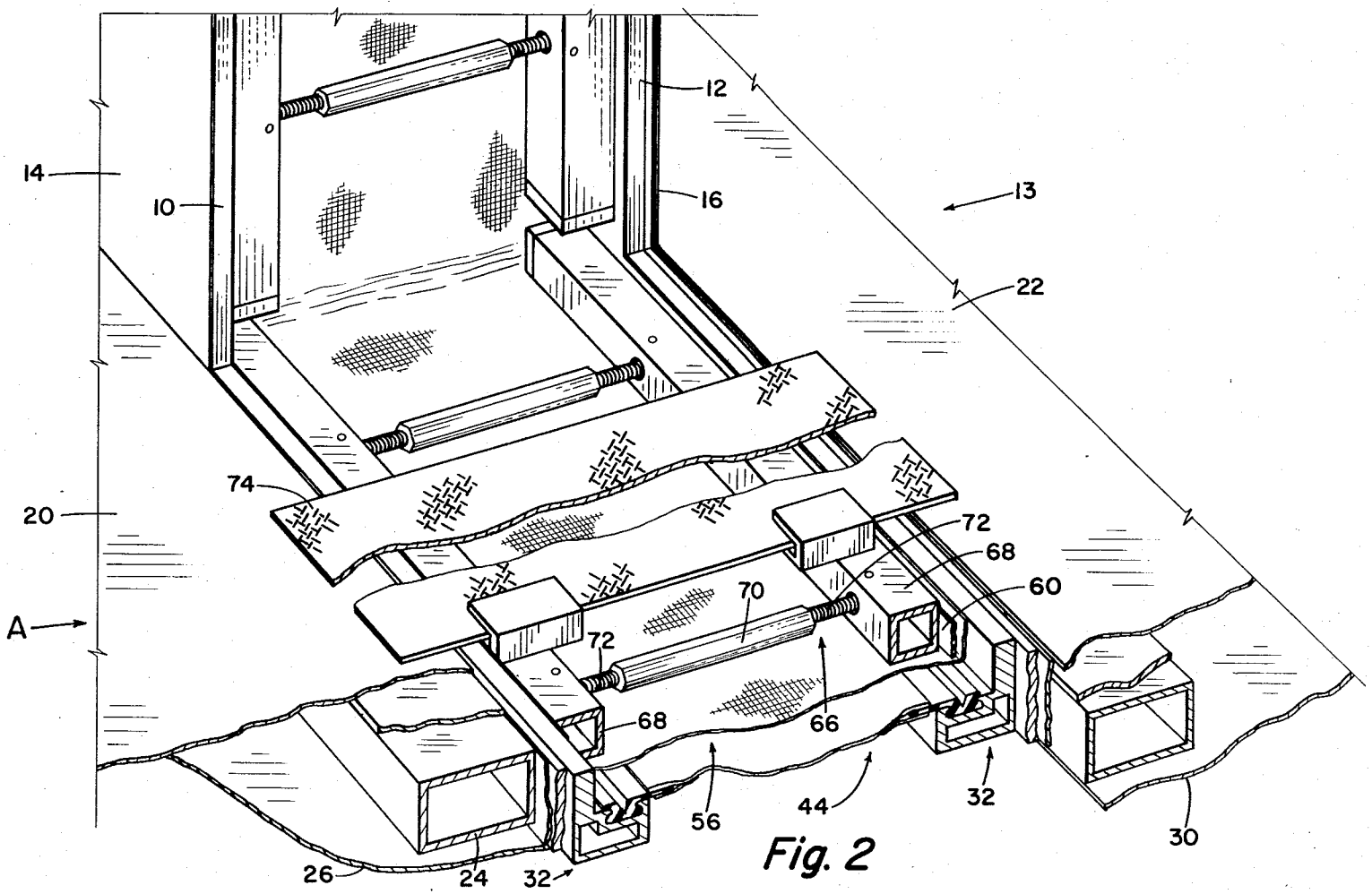
FIG. 2 is an isometric fragmentary view of a portion of buildings 1 and 2 showing primarily the portion of the floor cut away to reveal the structure employed in practicing the system of this invention.

Referring to FIG. 2 the floor and part of the vertical area at the opening between buildings will be described. The floor 20 and sidewall 14 of building A are shown. The floor 22 and a portion of the interior sidewall 16 of building B are shown. The opening 10 of building A and 12 of building B are in juxtaposed relationship and the building is to be used as a single entity requiring it to be joined in a weather proof and radio frequency proof manner. The floor structure of building A includes a box channel 24 with an upper floor surface 20 and a lower building covering 26. In like manner building B has a box channel 28 with material providing the upper floor surface 20 and a lower floor covering 30. Typically between surfaces 20 and 26 of building A and 22 and 30 of building B will be insulation (not shown). To secure the buildings together, an elongated extruded member 32 is affixed to both building A and B to circumscribe the openings 10 and 12. FIG. 6 is an enlarged cross-sectional view of extrusions 32. In a preferred arrangement of the extruded member 32 there is a box portion 34 having an opening 36 therein. Integrally extending from the box portion is a leg portion 38. The leg portion has one surface 38A which is coincident with one exterior surface of the box portion 34. Integrally formed in the exterior surface of the box portion is a groove 40 which is wider at the bottom than at the opening into the groove. The opening of groove 40 is formed by two integrally opposing elongated lip portions 42A and 42B.

Referring again to FIG. 2 the extruded members 32 are supported to each buildings with the exterior surface 38A of the leg portion in engagement with the building around the full perimeter of the opening. The extruded members 32 can be secured to the building openings such as by means of bolt, rivets, or the like. While extruded members 32 can be affixed to the buildings on location they may be supplied as a part of the buildings during construction which is accomplished in a factory so that when buildings arrive at their final destination the extruded members 32 will be a part of opening 10 and 12.

Figure 7:
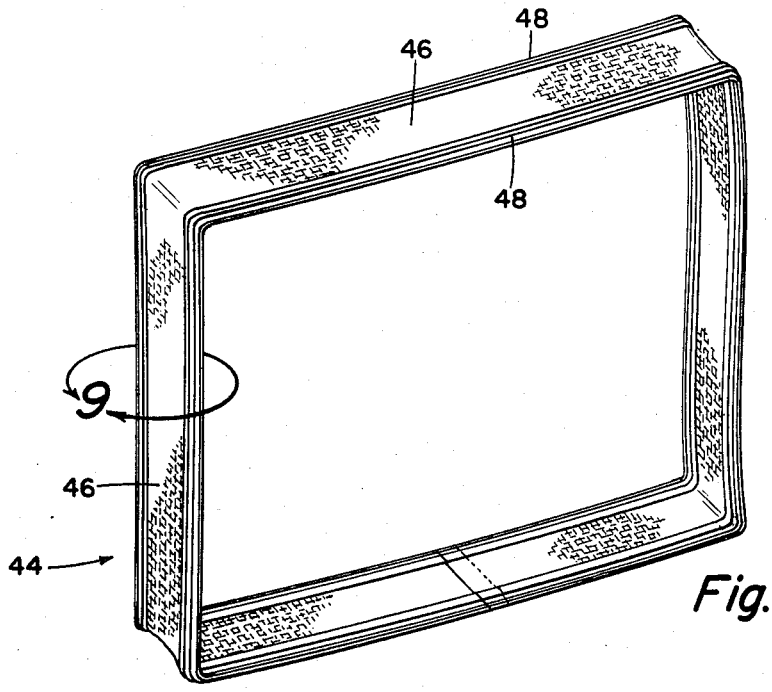
FIG. 7 is an isometric view of a weather proof boot as employed in this invention.
Figure 9:
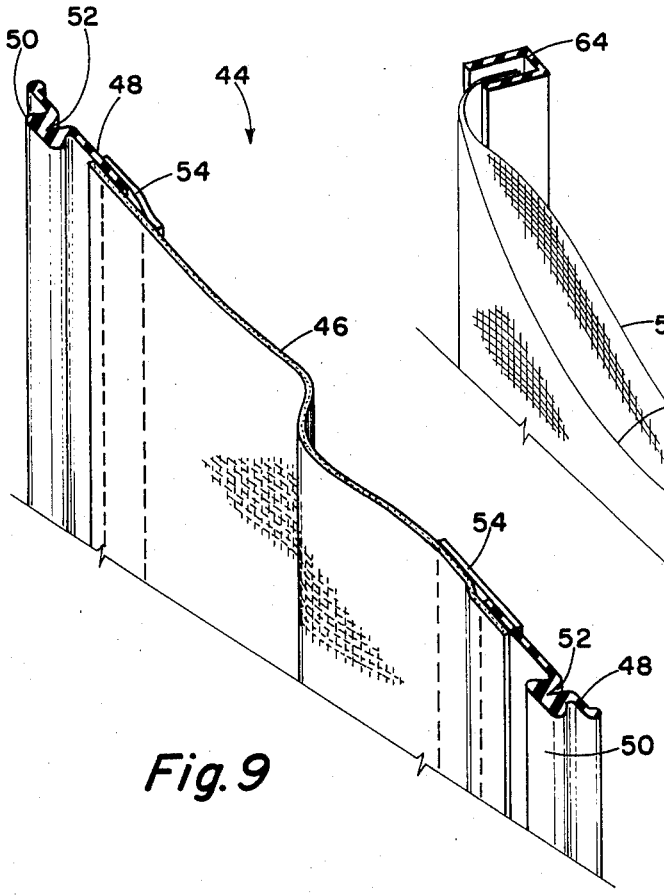
FIG. 9 is a cross-sectional view of the weather proof boot taken at the area 9 of FIG. 7.

The first step in joining the buildings is to install a weather proof boot. This is illustrated in FIG. 7, the weather proof boot being generally indicated by the numeral 44. FIG. 9 shows more details of the weather proof boot. It is a flexible member which, in its final installation is tubular in configuration. In cross-section, the boot 44 includes an intermediate flexible flat, relatively thin portion 46 formed such as of a sheet of natural or synthetic rubber or flexible plastic or laminated material formed of these components with a flexible reinforcement therein. Along opposed edges of the flat member 46 are extruded elastomeric member 48 which may be formed of natural or synthetic rubber or comparable material of plastic having resilient qualities. Each of the extruded elastomeric members 48 is generally flat and has an integral increased thickness portion 50 which is configured to be received in groove 40 of the extruded metal members 32. To assist in the insertion of the thickened portion 50 into groove 40, the extrusion preferably includes an elongated V-shaped slot 52. The portions 50 are inserted into groove 40 of extruded members 32 as shown in FIG. 2.

Referring again to FIG. 9, each edge of the flat portion 46 is secured to extruded elastomeric member 48 by means of a strip 54, which may be of the same material as the portion 46. The strips 54 are secured to the portion 46 along one edge such as by heat sealing, sewing, or any other means. The extruded member 48 is received between the flat member 46 and the strips 54 and bonded to it such as by heat sealing, sewing, rivoting or the like. The weather proof boot 44 does not need to be transported to the area of use in the configuration as shown in FIG. 7 which is shown in the dimension it receives when in use. Instead, due to the high degree of flexibility of the weather proof boot it may be formed into a roll for easy and compact transportation.

Figure 8:
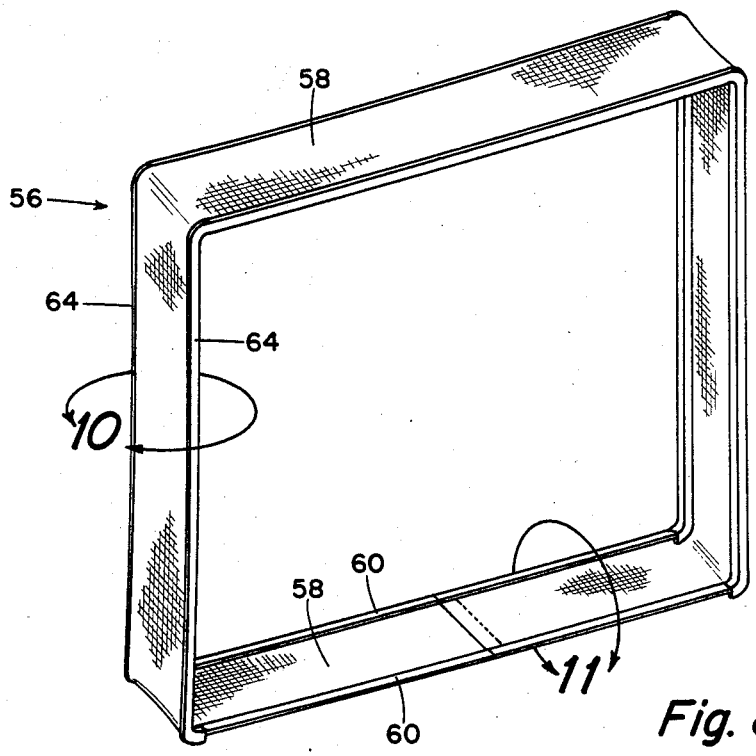
FIG. 8 is an isometric view of a radio frequency isolating boot as employed in the invention.
Figure 11:
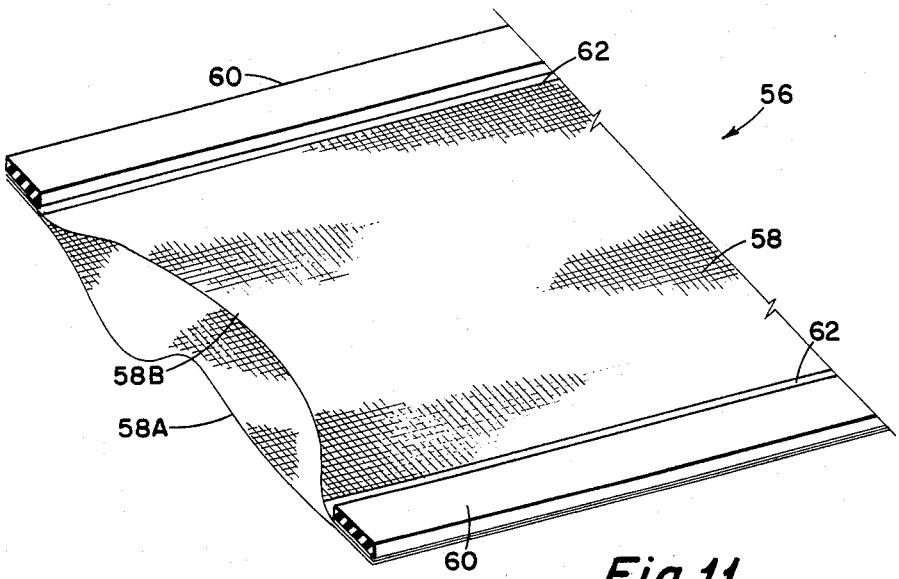
FIG. 11 is an enlarged cross-sectional view of the boot as taken at the floor area 11 of FIG. 8.
Figure 10:
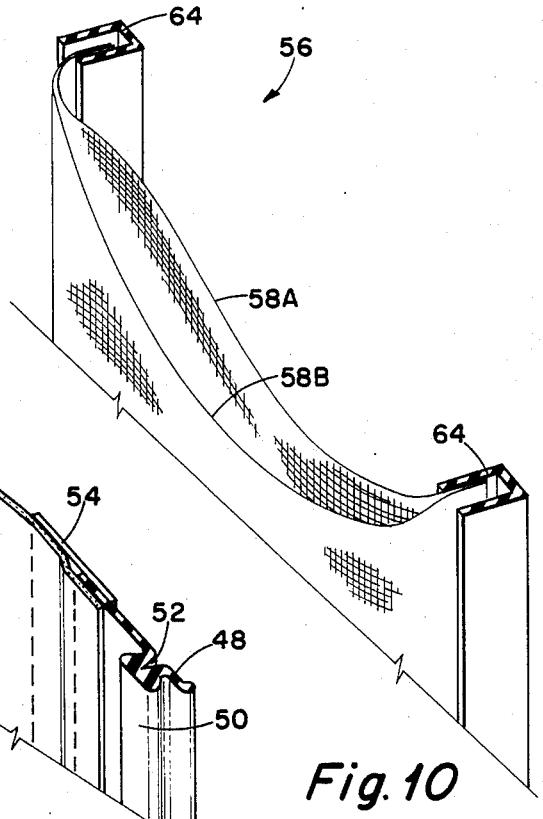
FIG. 10 is a cross-sectional view of the radio frequency boot taken at the sidewall area 10 of the FIG. 8.

The radio frequency boot 56 is illustrated in FIG. 8 and in cross-sectional views in FIGS. 10 and 11. The radio frequency boot is indicated by the numeral 56 and includes an intermediate portion formed of metallic screen wire, such as copper screen wire or the like. While a single thickness of screen wire may suffice, a preferred arrangement is to use two thicknesses 58A and 58B laying parallel to each other. To help hold the radio frequency boot screen portions 58A and 58B in position, an elongated flat elastomeric strip 60 is employed along each edge. This may be held in position by means of tape 62.

Another arrangement for the radio frequency screen 56 is shown in FIG. 10 in which a U-shaped elastomeric member 64 is used. The edges of the screens 58A and 58B are received in the U-shaped member 64 and employed in a manner to be described subsequently.

Returning to FIG. 2 it can be seen that the weather proof boot 44 is in position in the extruded members 52 and that the radio frequency proof boot 56 is also in position, the boot 56 being within the weather proof boot 44.

Figure 12:
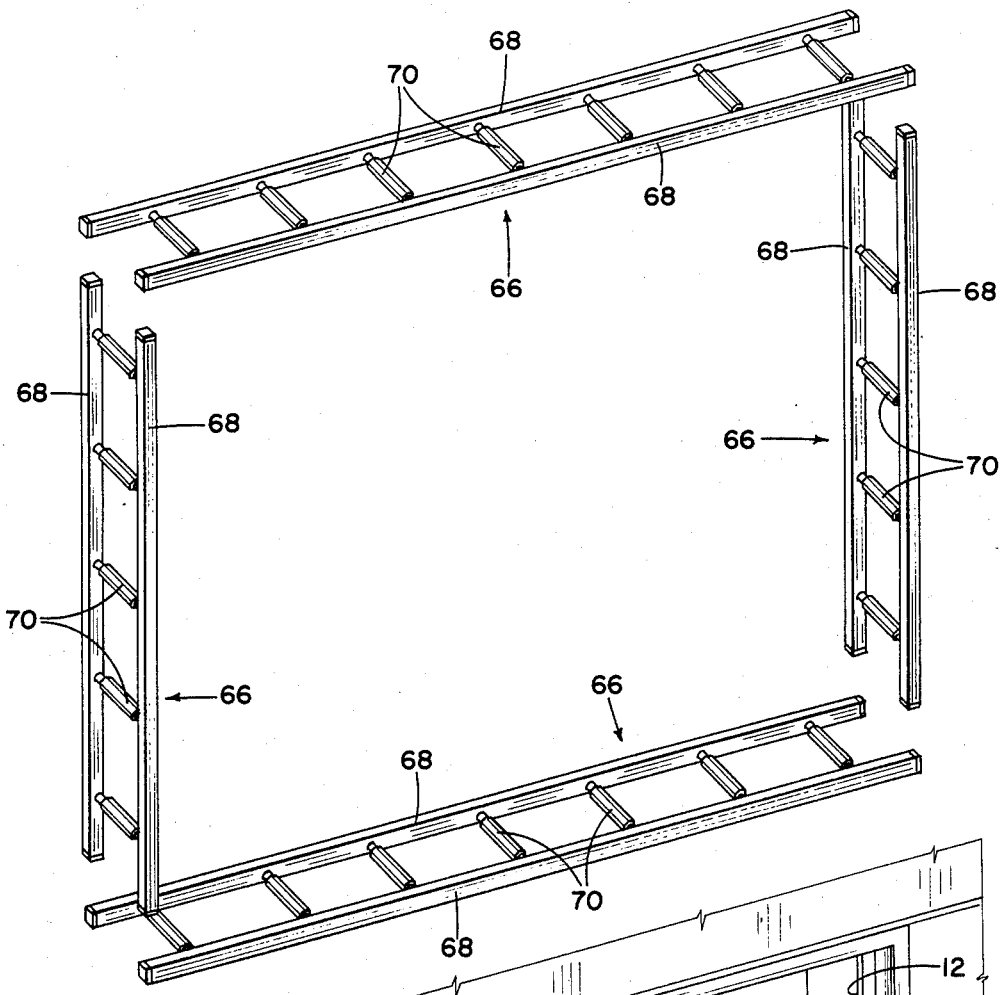
FIG. 12 is an isometric array of adjustable clamps which are used to secure the boots in position in the openings of adjacent buildings.
Figure 5:
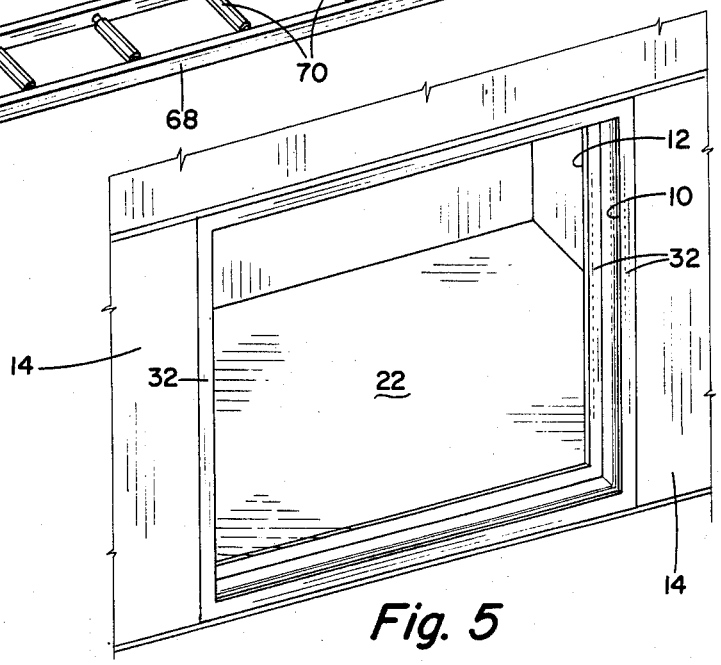
FIG. 5 is an isometric view showing the two adjacent buildings without the weather proof and radio frequency proof boots in place.

To hold the radio frequency boot 56 in secure electrical contact with both building A and building B, adjusting clamps are employed, the clamps being generally indicated by the numeral 66. The assembly of clamps 66 are shown in FIG. 12. Each of the clamps 66 includes an opposed rectangular extruded member 68 with intermediate turnbuckles 70. Each of the turnbuckles 70 include a central member having a threaded recess in each end, the threads being of reversed orientation and each receives a bolt portion extending from the rectangular members 68. By rotating the turnbuckle 70 in one direction the distance between the rectangular members 78 may be increased and by rotating the turnbuckle in the other direction the spacing may be decreased. It can be seen that with the weather proof boot 44 in position, the radio frequency proof boot may be positioned as shown and with the clamps 66 in place the turnbuckle 70 may be rotated to extend the rectangular members to force the screen wire portions into electrical contact with the leg portions 48 of the extruded members 32. In this manner the radio frequency boot is held into secure electrical contact with both buildings A and B.

To further complete the joining of the floor portions of the buildings, a floor plate 74 is placed over the juncture between the buildings to provide support for users of the building or for moving equipment from one building to the other.

Figure 3:
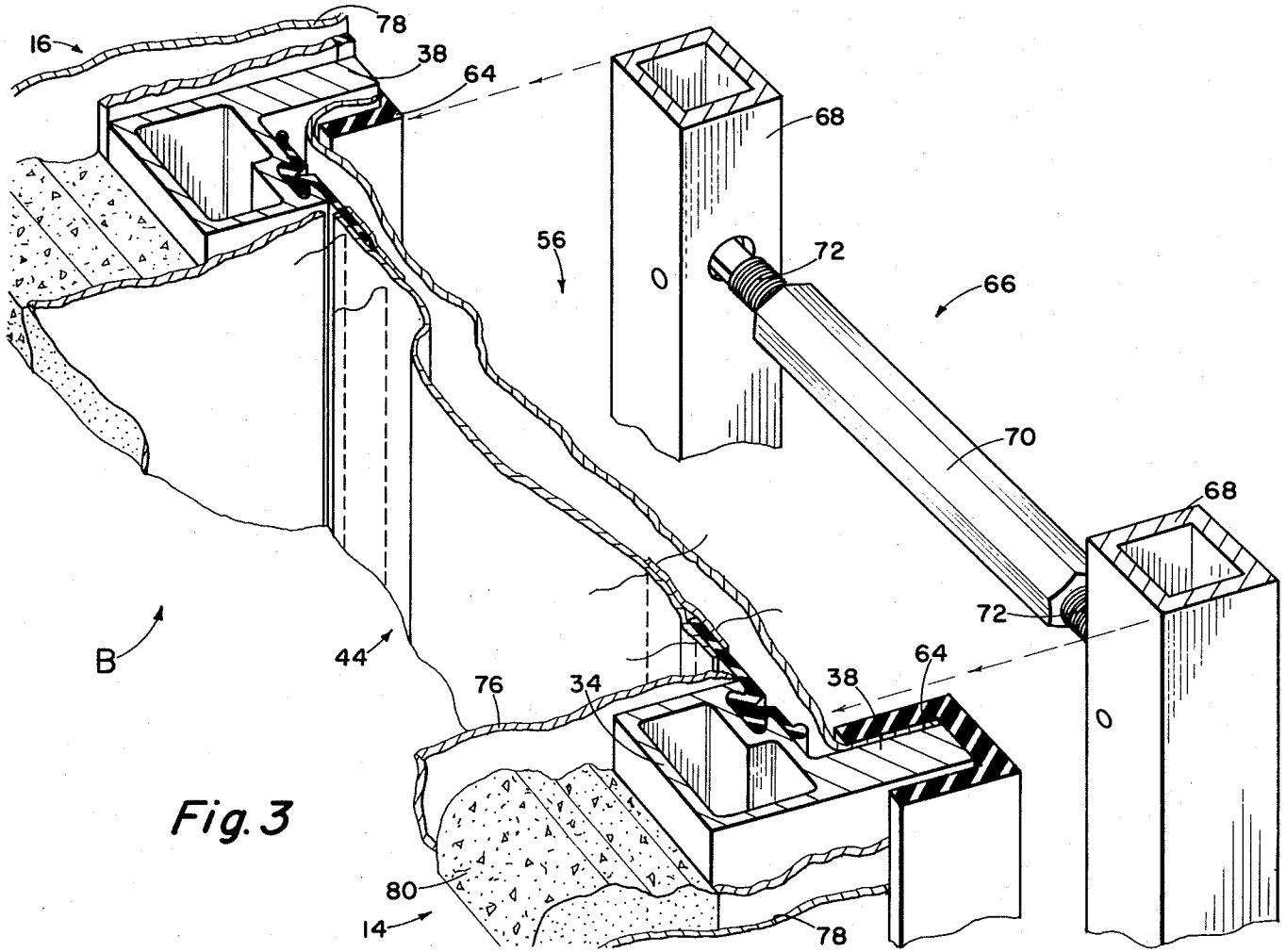
FIG. 3 is a fragmentary cross-sectional view of portions of the opening in two adjacent buildings showing the method of joining the sidewall portions of the openings.

Joining the sidewall and roof portions of the buildings A and B are accomplished in a substantially similar manner. Referring first to FIG. 3 the sidewall 14 of building A and the sidewall 16 of building B are shown. In the sidewalls the extruded members 32 (as discussed with reference to FIG. 6) are used in a somewhat different manner in that the box portion 34 is received between the sidewall interior skin 76 and the exterior skin 78, with insulation 80 therebetween. The weather proof boot 44 is first snapped into place within the channel 40 in the extruded members 32 and the radio frequency boot 56 is next installed, utilizing the U-shaped elastomeric members 64 as described with reference to FIG. 10. The U-shaped member 64 encompasses the extruded members leg portions 38 as well as a portion of the exterior building skin 78. To hold the edges of the radio frequency boot into electrical contact with the building and to hold the U-shaped elastomeric members 64 in position, a clamp 66 is inserted between the U-shaped elastomeric member 64 and extended by rotation of the turnbuckles 70.

Figure 4:
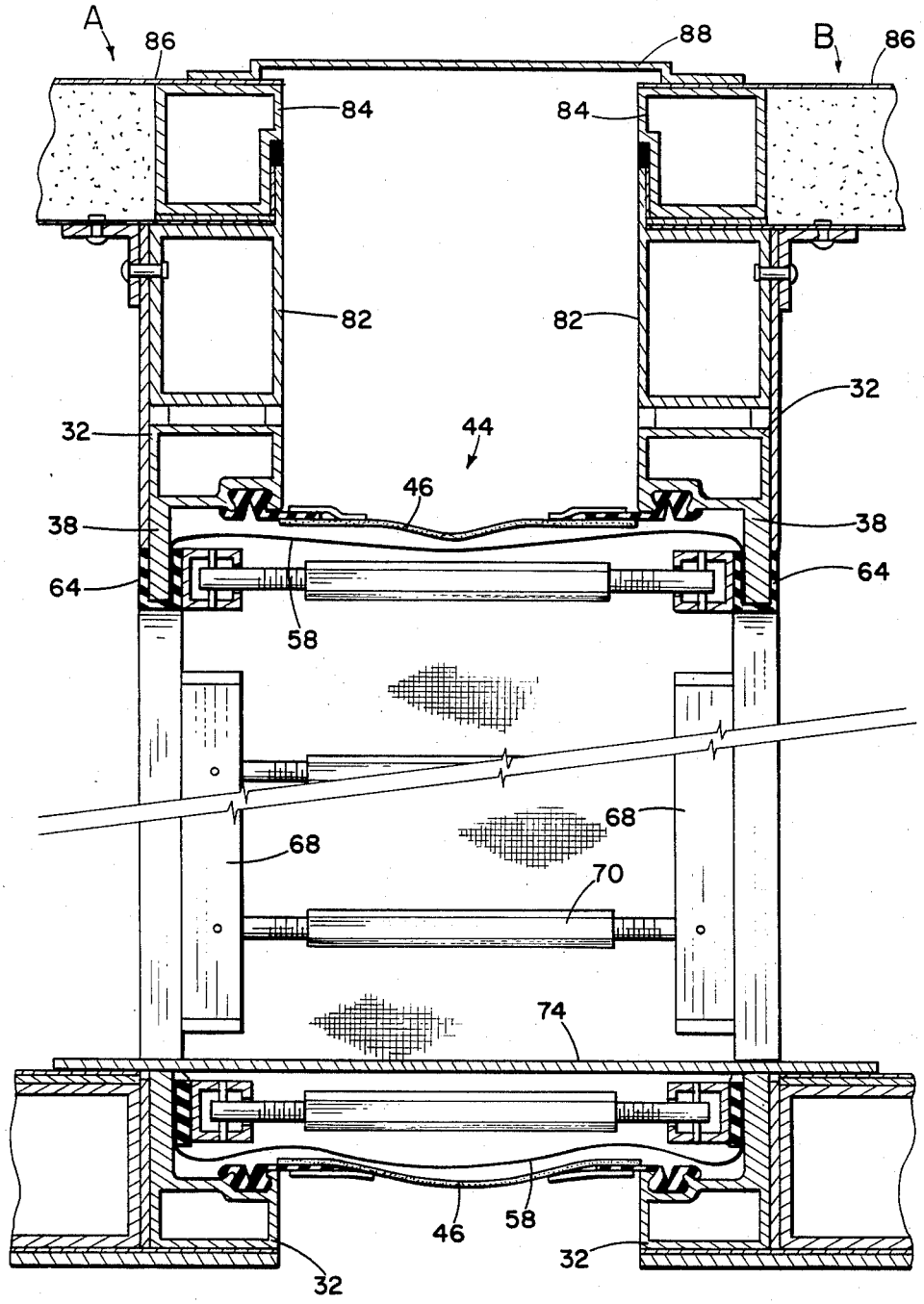
FIG. 4 is an internal elevational view of a passageway between two buildings showing means of practicing the invention for coupling the two buildings together to form a weather proof and radio frequency proof passageway.

FIG. 4 shows in cross-section the floor and the sidewall of the buildings at the opening between the two buildings A and B with the electrical and weather proof boots in place, and further shows the roof structure. The primary difference in the roof closure is that in order to support this span across the opening, extra structural members 82 and 84 are employed. These extra structural members 82 and 84 are comparable to headers utilized in typical framing construction since they must support the weight of the roof of the buildings across the expanse of the openings 10 and 12. The roof skins are indicated by 86. A top cover plate 88 is then secured over the opening. Cover plate 88 is not important for its weather proof or radio shielding but keeps rain and snow from accumulating in the space between the buildings in the area of the roof above the weather proof boot 44.

Thus it can be seen that with buildings constructed as set forth herein, having the extrusion of FIG. 6 completely surrounding openings where buildings are to be joined, the use of weather proof boots 44, radio frequency boots 56, and adjustable clamps 66 and all that are required to very quickly and expeditiously connect the buildings together. Because of the flexibility of the boots the buildings do not have to be in perfect alignment nor the openings in perfect orientation with each other. The joining of the buildings does not require any special tools or craftsmanship. The weather proof boots can be inserted by a workman employing a screwdriver or the like to force the thickened portions 50 into the groove 40 of the extruded members 32. A simple wrench can be used to tighten the turnbuckles to hold the radio frequency boots in secure electrical contact with the interior surfaces of the extruded member leg portions 38. Due to the flexibility of the coupling achieved, slight movement at one building relevant to the other will not destroy the integrity of the weather proof and radio frequency shield obtained.

While the invention has been described with a certain degree of particularity, it is manifest that many changes may be made in the details of construction and the arrangement of components without departing from the spirit and scope of this disclosure. It is understood that the invention is not to be limited to the specific embodiments set forth herein for purposes of exemplification but is to be limited only by the scope of the attached claim or claims, including the full range of equivalency to which each step or element thereof is entitled.

What is claimed is:

1. A system for forming a passageway between two adjacent buildings having opposed asymetrically spaced apart openings therein to provide radio shielding of the passageway, each building having an exposed conductive member around the opening therein, comprising;

a tubular boot of selectable length of flexible electrical frequency impervious material, the length of said boot being greater than said space between said two buildings at said opposed openings therein, the boot having a peripheral edge at each end thereof;

a plurality of separate, spaced apart, expandable members positioned between said two buildings for forcing on peripheral edge of said boot into electrical contact with the conductive member of one of said buildings and the other said peripheral edge of said boot into electrical contact with the conductive member of the other of the said buildings, the boot forming a short length tube communicating one building opening with the other.

2. A system for joining two adjacent building structures having opposed openings therein according to claim 1, including:

a tubular boot of selectable length of flexible weather impervious material having a circumferential edge at each end thereof, the length of said boot being at least equal to the spacing between the two buildings at said opposed openings therein; and means for sealably securing one said peripheral edge of said weather impervious boot to one of said buildings adjacent the said opening therein and to sealably secure the other said peripheral edge of said weather impervious boot the other said building adjacent the said opening therein, the said boot forming a short length tube sealably communicating one said building opening with the other, the said weather impervious boot and the said radio frequency impervious boot being positioned at its full length one inside the other.

3. A system for joining two adjacent building structures having opposed openings therein according to claim 1 wherein said expandable means comprises:

a plurality of clamp members, each clamp member comprising a first and a second opposed, elongated generally parallel structural member of length equal to approximately the height or width of the openings in the buildings; and a plurality of spaced apart turnbuckles between said opposed structural member, whereby by adjusting said turnbuckles the spacing between said structural members may be varied, said structural members serving to engage said peripheral edges of said electrical frequency impervious boot and, when said structural members are forced apart by adjustment of said turnbuckles, to force aid peripheral edges into conductive contact with the conductive members around said building openings.

4. A system for forming a passageway juncture between spaced apart building structures having opposed openings therein to provide weather and radio shielding of the juncture and wherein the buildings are not required to be in perfect parallel alignment comprising;

a tubular boot of flexible weather impervious material having a selected length and having a circumferential edge at each end thereof, the length being at least equal to the spacing between the two buildings at the opposed openings therein;

a tubular boot of flexible electrical frequency impervious material having a selected length and having a circumferential edge at each end thereof, the length being at least equal to the spacing between the two buildings at the opposed openings therein;

means of sealably securing one said circumferential edge of said weather impervious boot to one of said buildings adjacent said opening therein and to sealably secure the other said circumferential edge of said weather impervious boot to the other of said buildings adjacent said opening therein, the boot forming a short length tube sealably communicating one said building opening with the other; and means of radio frequency sealably securing one said circumferential edge of said radio frequency impervious boot to one of said buildings adjacent the said opening therein and to radio frequency sealably securing the other said peripheral edge of said radio frequency impervious boot to the other of said buildings adjacent the said openings therein, the boot forming short length tube communicating one said building opening with the other, said weather impervious boot and radio frequency impervious boot being positioned such that said radio frequency boot is placed inside and spaced from the weather impervious boot.

* * * * *